US009650708B2

(12) United States Patent
Becker et al.

(10) Patent No.: US 9,650,708 B2
(45) Date of Patent: May 16, 2017

(54) HIGH-STRENGTH FLAT STEEL PRODUCT AND METHOD FOR PRODUCING SAME

(75) Inventors: Jens-Ulrik Becker, Duisburg (DE); Jian Bian, Cologne (DE); Thomas Heller, Duisburg (DE); Rudolf Schoenenberg, Daphne, AL (US); Richard G. Thiessen, Malden (NL); Sabine Zeizinger, Mulheim (DE); Thomas Rieger, Düsseldorf (DE); Oliver Bulters, Ochtrup (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 544 days.

(21) Appl. No.: 14/117,711

(22) PCT Filed: May 16, 2012

(86) PCT No.: PCT/EP2012/059076

§ 371 (c)(1),
(2), (4) Date: May 2, 2014

(87) PCT Pub. No.: WO2012/156428

PCT Pub. Date: Nov. 22, 2012

(65) Prior Publication Data

US 2014/0322559 A1 Oct. 30, 2014

(30) Foreign Application Priority Data

May 18, 2011 (EP) ..... 11166622

(51) Int. Cl.
*C22C 38/02* (2006.01)
*C22C 38/04* (2006.01)
(Continued)

(52) U.S. Cl.
CPC ..... *C23C 2/02* (2013.01); *C21D 1/18* (2013.01); *C21D 1/19* (2013.01); *C21D 1/78* (2013.01);
(Continued)

(58) Field of Classification Search
None
See application file for complete search history.

(56) References Cited

U.S. PATENT DOCUMENTS

2001/0015245 A1 8/2001 Eberle et al.
2006/0011274 A1 1/2006 Speer et al.
(Continued)

FOREIGN PATENT DOCUMENTS

CA 2734976 A1 3/2010
CN 101932745 A 12/2010
(Continued)

*Primary Examiner* — Deborah Yee
(74) *Attorney, Agent, or Firm* — The Webb Law Firm

(57) ABSTRACT

A flat steel product having a tensile strength of at least 1200 MPa and consists of steel containing (wt %) C: 0.10-0.50%, Si: 0.1-2.5%, Mn: 1.0-3.5%, Al: up to 2.5%, P: up to 0.020%, S: up to 0.003%, N: up to 0.02%, and optionally one or more of the elements "Cr, Mo, V, Ti, Nb, B and Ca" in the quantities: Cr: 0.1-0.5%, Mo: 0.1-0.3%, V: 0.01-0.1%, Ti: 0.001-0.15%, Nb: 0.02-0.05%, wherein Σ(V, Ti, Nb)≤0.2% for the sum of the quantities of V, Ti and Nb, B: 0.0005-0.005%, and Ca: up to 0.01% in addition to Fe and unavoidable impurities. The flat steel product has a microstructure with (in surface percent) less than 5% ferrite, less than 10% bainite, 5-70% untempered martensite, 5-30% residual austenite, and 25-80% tempered martensite, at least 99% of the iron carbide contained in the tempered martensite having a size of less than 500 nm.

17 Claims, 1 Drawing Sheet

(51) Int. Cl.

| | |
|---|---|
| ***C22C 38/06*** | (2006.01) |
| ***C22C 38/18*** | (2006.01) |
| ***C21D 9/00*** | (2006.01) |
| ***C21D 1/18*** | (2006.01) |
| ***C21D 1/22*** | (2006.01) |
| ***C23C 2/02*** | (2006.01) |
| ***C21D 1/19*** | (2006.01) |
| ***C21D 1/78*** | (2006.01) |
| ***C21D 8/02*** | (2006.01) |
| ***C21D 8/04*** | (2006.01) |
| ***C22C 38/00*** | (2006.01) |
| ***C22C 38/14*** | (2006.01) |
| ***C22C 38/12*** | (2006.01) |
| ***C21D 6/00*** | (2006.01) |
| ***C22C 38/28*** | (2006.01) |
| ***C22C 38/32*** | (2006.01) |
| ***C22C 38/34*** | (2006.01) |
| ***C22C 38/38*** | (2006.01) |

(52) U.S. Cl.

CPC ..... *C21D 6/002* (2013.01); *C21D 8/0247* (2013.01); *C21D 8/0447* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/28* (2013.01); *C22C 38/32* (2013.01); *C22C 38/34* (2013.01); *C22C 38/38* (2013.01); *C21D 2211/008* (2013.01); *Y10T 428/12799* (2015.01)

(56) References Cited

U.S. PATENT DOCUMENTS

| | | | |
|---|---|---|---|
| 2011/0146852 | A1 | 6/2011 | Matsuda et al. |
| 2011/0198002 | A1 | 8/2011 | Nakagaito et al. |
| 2013/0133786 | A1 | 5/2013 | Matsuda et al. |

FOREIGN PATENT DOCUMENTS

| | | | |
|---|---|---|---|
| EP | 2267176 | A1 | 12/2010 |
| EP | 2546368 | A1 | 1/2013 |
| JP | 693340 | A | 4/1994 |
| JP | 2009209450 | A | 9/2009 |
| JP | 201090475 | A | 4/2010 |
| JP | 2010285636 | A | 12/2010 |
| JP | 2011184757 | A | 9/2011 |
| WO | 2004022794 | A1 | 3/2004 |

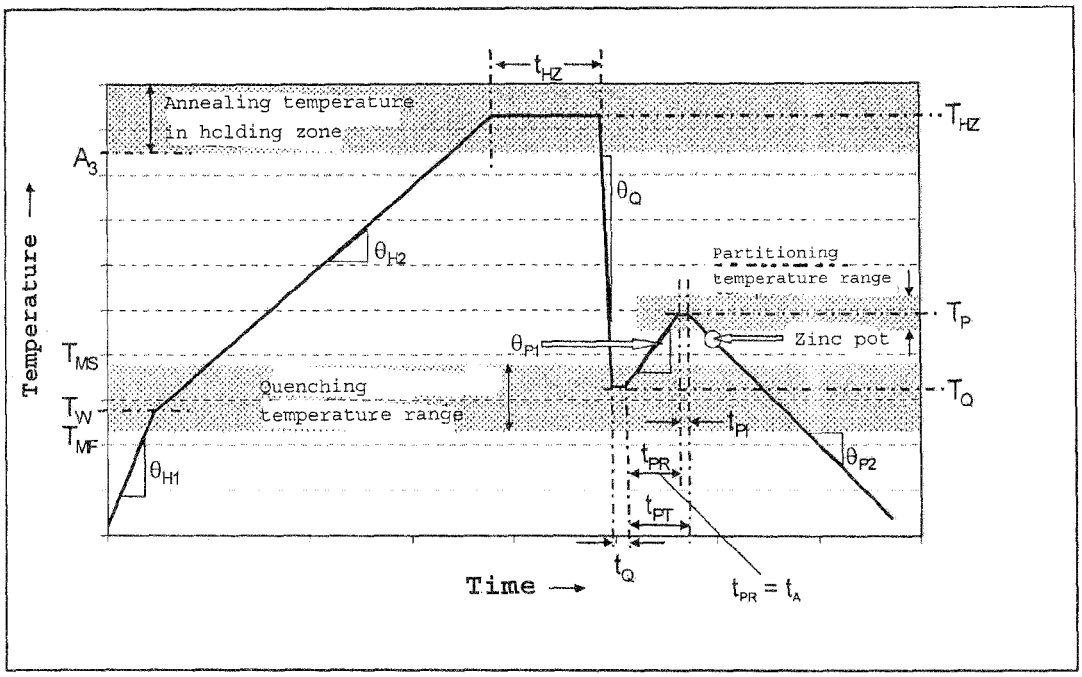
Annealing temperature
in holding zone
$t_{HZ}$
$T_{HZ}$
$A_3$
$\theta_Q$
$\theta_{H2}$
Partitioning
temperature range
$T_P$
$\theta_{P1}$
Zinc pot
$T_{MS}$
Quenching
temperature range
$T_Q$
$T_W$
$T_{MF}$
$t_{PI}$
$\theta_{H1}$
$t_{PR}$
$\theta_{P2}$
$t_{PT}$
$t_Q$
$t_{PR} = t_A$
Temperature
Time

HIGH-STRENGTH FLAT STEEL PRODUCT AND METHOD FOR PRODUCING SAME

CROSS-REFERENCE TO RELATED APPLICATIONS

This application is the United States national phase of International Application No. PCT/EP2012/059076 filed May 16, 2012 and claims priority to European Patent Application No. 11166622.8 filed May 18, 2011, the disclosures of which are hereby incorporated by reference in their entirety.

BACKGROUND OF THE INVENTION

Field of the Invention

The invention relates to a high-strength flat steel product and a method for producing such a flat steel product.

In particular the invention relates to a high-strength flat steel product provided with a metallic protective layer and a method for producing such a product.

Description of Related Art

Where flat steel products are referred to here, this is intended to mean steel strip, sheet or cut sheet metal items obtained from these, such as blanks.

Unless expressly stated to the contrary, in the present text and in the claims the quantities of certain alloying elements are in each case given in wt % and the proportions of certain components of the microstructure in surface percent.

Where in the following cooling or heating speeds or rates are mentioned, then cooling speeds are given in the negative as they lead to a drop in temperature. Accordingly, in the case of rapid cooling, cooling rates have a lower value than for slower cooling. On the other hand, heating speeds leading to an increase in temperature are given in the positive.

Because of their alloying components, high-strength steels have a general tendency to corrode and therefore are typically covered with a metallic protective layer, which protects the respective steel substrate from contact with ambient oxygen. A number of methods for applying such a metallic protective layer are known. These include hot-dip coating, also referred to in the technical jargon as "hot-dip coating", and electrolytic coating.

Whereas with electrolytic coating the coating metal is deposited electrochemically on the flat steel product to be coated, which in any case becomes slightly heated during the process, in hot-dip coating the products to be coated undergo heat treatment prior to dipping in the respective molten bath. In the process the respective flat steel product is heated under a certain atmosphere to high temperatures, in order to arrive at the desired microstructure and create an optimum surface state for adherence of the metallic coating. Then the flat steel product passes through the molten bath, which similarly is at a raised temperature, in order to keep the coating material in the molten state.

The necessarily high temperatures mean that in hot-dip coating the strength of flat steel products provided with a metallic protective layer has an upper limit of 1000 MPa. Flat steel products with an even higher strength as a rule cannot be hot-dipped, since as a result of the attendant heating resulting from tempering they experience considerable losses in strength. As a result, these days high-strength flat steel products are usually provided with a metallic protective layer electrolytically. This work step calls for a flawless and clean surface, which in practice can only be achieved by pickling prior to the electrolytic coating.

EP 2 267 176 A1 discloses a method for producing a high-strength, cold-rolled strip with a metallic protective coating applied by hot-dip coating, comprising the following work steps:

- hot-rolling a hot-rolled strip from a slab,
- cold-rolling the hot-rolled strip into a cold-rolled strip,
- heat treating the cold-rolled strip, wherein in the course of this heat treatment
  - the cold-rolled strip is heated at an average speed of a maximum of 2° C./s from a temperature which is 50° C. lower than the Ac3 temperature of the steel, of which the cold-rolled strip is comprised, to the respective Ac3 temperature,
  - the cold-rolled strip is then held for at least 10 seconds at a temperature that at least corresponds to the respective Ac3 temperature,
  - whereupon the cold-rolled strip is cooled at an average speed of a minimum of 20° C./s to a temperature which is 100-200° C. below the martensite start temperature of the respective steel process and
  - finally the cold-rolled strip is heated for between 1 and 600 seconds to a temperature of 300-600° C.

Lastly, the steel strip is hot-dip galvanized. The metallic coating applied here is preferably a zinc coating. Ultimately in this way a cold-rolled strip shall be obtained with optimised mechanical properties, such as a tensile strength of at least 1200 MPa, an elongation of at least 13% and a hole expansion of at least 50%.

The cold-rolled strip processed in the above manner shall comprise a steel, that contains (in wt %) 0.05-0.5% C, 0.01-2.5% Si, 0.5-3.5% Mn, 0.003-0.100% P, up to 0.02% S, and 0.010-0.5% Al, in addition to iron and unavoidable impurities. At the same time the steel shall have a microstructure, having (in surface %) less than 10% ferrite, less than 10% martensite and 60-95% untempered martensite and also 5-20% residual austenite, determined by X-ray diffractometry. Furthermore, the steel can contain (in wt %) 0.005-2.00% Cr, 0.005-2.00% Mo, 0.005-2.00% V, 0.005-2.00% Ni and 0.005-2.00% Cu and 0.01-0.20% Ti, 0.01-0.20% Nb, 0.0002-0.005% B, 0.001-0.005% Ca and 0.001-0.005% rare earth elements.

SUMMARY OF THE INVENTION

Against the background of the state of the art illustrated above the object of the invention consisted in indicating a high-strength flat steel product, having further optimised mechanical properties which in particular are expressed in the form of a very good bending behaviour.

Furthermore a method should be indicated for producing such a flat steel product. In particular, this method should be incorporated in a process for hot-dip coating of flat steel products.

In relation to the method the object is achieved according to the invention in that when producing a flat steel product according to the invention at least the work steps indicated in claim 6 are completed. In order to allow incorporation of the method according to the invention into a process for hot-dip coating, as an option the work steps specified in claim 7 can be carried out here.

Advantageous embodiments of the invention are specified in the dependent claims and are explained in detail in the following together with the general inventive concept.

DESCRIPTION OF THE INVENTION

A flat steel product according to the invention, optionally provided with a metallic protective layer by a hot-dip coating process, has a tensile strength $R_m$ of at least 1200 MPa. Furthermore, a flat steel product according to the invention is routinely characterised by:

a yield strength $R_{P0.2}$ of 600-1400 MPa, a yield-to-tensile ratio $R_P/R_m$ of 0.40-0.95, an elongation $A_{50}$ of 10-30%, a product $R_m*A_{50}$ of the tensile strength $R_m$ and the elongation $A_{50}$ of 15000-35000 MPa*%, a hole expansion of λ: 50-120% (λ=(df−d0)/d0 in [%] where df=Hole diameter after expansion and d0=hole diameter before expansion) and a range for the permitted bending angle α (after spring-back with a mandrel radius=2×sheet thickness) of 100°-180° (measurable according to DIN EN 7438).

To that end a flat steel product according to the invention consists of a steel that contains (in wt %) C: 0.10-0.50%, Si: 0.1-2.5%, Mn: 1.0-3.5%, Al: up to 2.5%, P: up to 0.020%, S: up to 0.003%, N: up to 0.02%, and optionally one or more of the elements "Cr, Mo, V, Ti, Nb, B and Ca" in the following quantities: Cr: 0.1-0.5%, Mo: 0.1-0.3%, V: 0.01-0.1%, Ti: 0.001-0.15%, Nb: 0.02-0.05%, wherein Σ(V,Ti,Nb)≤0.2% for the sum Σ(V,Ti,Nb) of the quantities of V, Ti and Nb, B: 0.0005-0.005%, and Ca: up to 0.01% in addition to iron and unavoidable impurities.

It is important for the mechanical properties considered of the flat steel product according to the invention that it has a microstructure (in surface percent) with less than 5% ferrite, less than 10% bainite, 5-70% untempered martensite, 5-30% residual austenite and 25-80% tempered martensite. Here at least 99% of the iron carbide contained in the tempered martensite has a size of less than 500 nm.

Here the phase fractions of untempered and tempered martensite, of bainite and of ferrite are determined in the normal manner according to ISO 9042 (optical determination). The residual austenite can also be determined by X-ray diffractometry with an accuracy of +/−1 surface percent.

Accordingly, in a flat steel product according to the invention the content of so-called "over-tempered martensite" is reduced to a minimum. Over-tempered martensite is characterised in that more than 1% of the quantity of carbide grains (iron carbide) is greater than 500 nm in size. Over-tempered martensite can by way of example be determined using a scanning electron microscope, at a 20000× magnification, from steel samples etched with 3% nitric acid. By avoiding over-tempered martensite a flat steel product according to the invention achieves optimised mechanical properties which, in particular in respect of its bending properties, characterised by a high bending angle α of 100° to 180°, have a beneficial effect.

The C-content of the steel of a flat steel product according to the invention is limited to values of between 0.10 and 0.50 wt %. Carbon influences a flat steel product according to the invention in a number of ways. Firstly C plays a major role in the formation of the austenite and the lowering of the Ac3 temperature. Thus a sufficient concentration of C allows complete austenitisation at temperatures of ≤960° C. even if at the same time elements such as Al are still present which increase the Ac3 temperature. Quenching also stabilises the residual austenite through the presence of C. This effect continues during the partitioning step. A stable residual austenite leads to a maximum elongation area, in which the TRIP (TRansformation Induced Plasticity) effect makes itself felt. Furthermore the strength of the martensite at its greatest is influenced by the respective C content. Excessive contents of C lead to such a great shift in the martensite starting temperature to ever lower temperatures that creation of the flat steel product according to the invention is made exceedingly difficult. Furthermore, excessive C contents can have a negative effect on weldability.

In order to ensure a good surface quality of a flat steel product according to the invention, the Si content in the steel of the flat steel product according to the invention shall be less than 2.5 wt %. Silicon is important to suppress cementite formation, however. The formation of cementite would cause the C to fix as carbide and thus no longer be available to stabilise the residual austenite. The elongation would also be impaired. The effect achieved by the addition of Si can to some extent also be achieved by adding aluminium. But a minimum of 0.1 wt % Si should always be present in the flat steel product according to the invention to take advantage of this positive effect.

Manganese contents of 1.0-3.5 wt %, especially of up to 3.0 wt %, are important for the hardenability of the flat steel product according to the invention and avoiding perlite formation during cooling. These properties allow the formation of a starting microstructure comprising martensite and residual austenite and which as such is suitable for the partitioning step performed according to the invention. Manganese has also proven to be beneficial for setting comparatively low cooling rates of for example faster than −100K/s. An excessive Mn concentration, however, impacts negatively on the elongation properties and the weldability of the flat steel product according to the invention.

Aluminium is present in the steel of a flat steel product according to the invention in quantities of up to 2.5% for deoxidation and fixing of any nitrogen present. As mentioned, Al can also be used to suppress cementite, however, and in so doing has less of a negative effect on the surface quality than high contents of Si. Al is less effective than Si, however, and also increases the austenitisation temperature. The Al content of a flat steel product according to the invention is therefore limited to a maximum of 2.5 wt % and preferably to values between 0.01 and 1.5 wt %.

Phosphorous adversely affects weldability and should therefore be present in the steel of a flat steel product according to the invention in quantities of less than 0.02 wt %.

In sufficient concentration sulphur leads to the formation of MnS or (Mn,Fe)S, which has a negative effect on elongation. Therefore the S content in the steel of a flat steel product according to the invention shall be below 0.003 wt %.

Fixed as nitride, nitrogen in the steel of a flat steel product according to the invention is detrimental to formability. The N content of a flat steel product according to the invention shall therefore be less than 0.02 wt %.

In order to improve certain properties "Cr, Mo, V, Ti, Nb, B and Ca" may be present in the steel of a flat steel product according to the invention.

So in order to optimise the strength it can be appropriate to add one or more of the micro-alloying elements V, Ti and Nb to the steel of a flat steel product according to the invention. Through the formation of very finely distributed carbides or carbonitrides these elements contribute to a higher strength. A minimal Ti content of 0.001 wt % results in freezing of the grain and phase boundaries during the partitioning step. An excessive concentration of V, Ti and Nb can be detrimental to stabilisation of the residual austenite, however. Therefore the total quantities of V, Ti and Nb in a flat steel product according to the invention is limited to 0.2 wt %.

Chromium is a more effective perlite inhibitor, adding strength, and up to 0.5 wt % may therefore be added to the steel of a flat steel product according to the invention. Above 0.5 wt % there is a danger of pronounced grain boundary oxidation. In order to be able to make definite use of the positive effect of Cr, the Cr content can be set at 0.1-0.5 wt %.

Like Cr, molybdenum is also a very effective element for suppressing perlite formation. To make effective use of this beneficial effect, 0.1-0.3 wt % can be added to the steel of a flat steel product according to the invention.

Boron segregates at the grain boundaries and slows their movement. For contents in excess of 0.0005 wt % this leads to a fine-grained microstructure with a beneficial effect on the mechanical properties. Where B is added, however, sufficient Ti must be present for fixing the N. At a content of approximately 0.005 wt % saturation of the positive effect of B occurs. Therefore the B content is set at 0.0005-0.005 wt %.

Calcium is used in contents of up to 0.01 wt % in the steel of a flat steel product according to the invention to fix sulphur and for inclusion modification.

The carbon equivalent CE is an important parameter in describing weldability. For the steel of a flat steel product according to the invention it should be in the range 0.35-1.2, in particular 0.5-1.0. To calculate the carbon equivalent CE use is made here of a formula developed by the American Welding Society (AWS) and published in publication D1.1/D1.1M:2006, Structural Welding Code —Steel. Section 3.5.2. (Table 3.2), pages 58 and 66:

$$CE=\%\ C+(\%\ Mn+\%\ Si)/6+(\%\ Cr+\%\ Mo+\%\ V)/5+(\%\ Ni+\%\ Cu)/15,$$

Where % C: C content of the steel,
% Mn: Mn content of the steel,
% Si: Si content of the steel,
% Cr: Cr content of the steel,
% Mo: No content of the steel,
% V: V content of the steel,
% Ni: Ni content of the steel,
% Cu: Cu content of the steel.

The method according to the invention for producing a high-strength, flat steel product, optionally provided with a metallic protective layer, applied by hot-dip coating, comprises the following work steps:

An uncoated flat steel product is provided, i.e. one that does not yet have a protective layer, produced from the same steel as the flat steel product already illustrated above. Accordingly, the steel which the flat steel product consists of contains (in wt %) C: 0.10-0.50%, Si: 0.1-2.5%, Mn: 1.0-3.5%, Al: up to 2.5%, P: up to 0.020%, S: up to 0.003%, N: up to 0.02%, and optionally one or more the elements "Cr, Mo, V, Ti, Nb, B and Ca" in the following quantities: Cr: 0.1-0.5%, Mo: 0.1-0.3%, V: 0.01-0.1%, Ti: 0.001-0.15%, Nb: 0.02-0.05%, wherein $\Sigma(V,Ti,Nb)\leq 0.2\%$ for the sum $\Sigma(V,Ti,Nb)$ of the quantities of V, Ti and Nb, B: 0.0005-0.005%, and Ca: up to 0.01% in addition to iron and unavoidable impurities. The flat steel product provided can in particular be a cold-rolled flat steel product. Processing of a hot-rolled flat steel product in an inventive manner is also conceivable, however.

The flat steel product provided in this way is then heated to an austenitisation temperature $T_{HZ}$ above the Ac3 temperature of the steel of the flat steel product and with a maximum of 960° C. at a heating speed $\theta_{H1}$, $\theta_{H2}$ of at least 3° C./s. Rapid heating shortens the process time and improves the overall economic efficiency of the method.

Heating to the austenitisation temperature $T_{HZ}$ can take place in two consecutive stages without interruption at different heating speeds $\theta_{H1}$, $\theta_{H2}$.

Heating at lower temperatures, i.e. below $T_W$, can take place very quickly here in order to increase the economic efficiency of the process. At higher temperatures dissolution of carbides begins. For this, lower heating speeds $\theta_{H2}$ are beneficial to achieve an even distribution of the carbon and other possible alloying elements such as Mo or Cr. The carbides are already dissolved in a controlled manner at below $A_{c1}$ temperature, in order to take advantage of the faster diffusion of the ferrite compared to the slower diffusion in the austenite. Hence the dissolved atoms as a result of a lower heating speed $\theta_{H2}$ are able to distribute more evenly in the material.

To produce the most homogenous possible material, a limited heating speed $\theta_{H2}$ is also beneficial during the austenite conversion, i.e. between $A_{c1}$ and $A_{c3}$. This contributes to a homogenous starting microstructure prior to quenching and thus an evenly distributed martensite and a fine residual austenite following quenching, and finally to improved mechanical properties of the flat steel product.

It has proved appropriate, at temperatures of between 200-500° C. to reduce the heating speed. Here it transpires surprisingly that even heating speeds of 3-10° C./s can still be set without compromising the outcome sought.

In order to achieve the properties sought according to the invention of a flat steel product, consequently in the two-stage heating the heating speed of the first step can be 5-25° C./s and the heating speed $\theta_{H2}$ of the second step 3-10° C., in particular 3-5° C./s. Here the flat steel product with the first heating speed $\theta_{H1}$ can be heated to an intermediate temperature $T_W$ of 200-500° C., in particular 250-500° C., and the heating then continued at the second heating speed $\theta_{H2}$ to the austenitisation temperature $T_{HZ}$.

Upon reaching the austenitisation temperature $T_{HZ}$, in accordance with the invention the flat steel product is held at the austenitisation temperature $T_{HZ}$ for an austenitisation period $t_{HZ}$ of 20-180 s. Here the annealing temperature in the holding zone shall be above the $A_{c3}$-temperature, in order to achieve full austenitisation.

The $A_{c3}$-temperature of the respective steel is a function of the analysis and can be recorded either by conventional measurement techniques or for example estimated with the following empirical equation (alloy contents used in wt %):

$$A_{c3}[°\ C.]=910-203\sqrt{\%\ C}-15.2\%\ Ni+44{,}7\%\ Si+31.5\%\ Mo+104\%\ V$$

where % C: C content of the steel,
% Ni: Ni content of the steel,
% Si: Si content of the steel,
% Mo: No content of the steel,
% V: V content of the steel.

After annealing at temperatures above $A_{c3}$ the flat steel product is cooled to a cooling stop temperature $T_Q$, greater than the martensite stop temperature $T_{Mf}$ and less than the martensite start temperature $T_{Ms}$ ($T_{Mf}<T_Q<T_{Ms}$), at a cooling speed $\theta_Q$.

Cooling to the cooling stop temperature $T_Q$ takes place according to the invention on condition that the cooling speed $\theta_Q$ is at least the same, preferably faster, than a minimum cooling speed $\theta_{Q(min)}$ ($\theta_Q\leq\theta_{Q(min)}$) Here the minimum cooling speed $\theta_{Q(min)}$ can be calculated according to the following empirical formula:

$$\theta_{Q(min)}[^\circ\ C./s] = -314,35^\circ\ C./s + (268.74\%\ C + 56.27\%\ Si + 58.50\%\ Al + 43.40\%\ Mn + 195.02\%\ Mo + 166.60\%\ Ti + 199.19\%\ Nb)\ ^\circ\ C./(wt\ \% \cdot s)$$

Where % C: C content of the steel,
% Si: Si content of the steel,
% Al: Al content of the steel,
% Mn: Mn content of the steel,
% Mo: Mo content of the steel,
% Ti: Ti content of the steel,
% Nb: Nb content of the steel.

The cooling speed $\theta_Q$ is typically in the range −20° C./s to −120° C./s. At cooling speeds $\theta_Q$ of −51° C./s to −120° C./s in practice the condition $\theta_Q \leq \theta_{Q(min)}$ can only be met with certainty for steels with a low C or Mn content.

If the minimum cooling speed $\theta_{Q(min)}$ is observed, a ferritic and bainitic conversion is safely prevented and a martensitic microstructure is set in the flat steel product with up to 30% residual austenite.

How much martensite is actually produced during cooling depends on the extent to which the flat steel product is cooled during cooling to below the martensite start temperature ($T_{MS}$) and on the holding time $t_Q$, for which the flat steel product is held at the cooling stop temperature following accelerated cooling. According to the invention for the holding time $t_Q$ a spread of 10-60 seconds, in particular 12-40 seconds, is provided for. During approximately the first 3 to 5 seconds of holding thermal homogenisation occurs in parallel with the martensitic conversion. In the subsequent seconds by means of C diffusion, displacements are pinned and the finest depositions appear. So an extension to the holding time initially causes an increase in martensite content and thus in the yield strength. As holding time increases this effect becomes weaker, wherein in accordance with the invention after approximately 60 seconds a reduction in yield strength can be observed.

In parallel to the increase in yield strength, through the cooling performed according to the invention to the cooling stop temperature and subsequent holding of the flat steel product at this temperature for the times specified according to the invention, an improvement in forming properties is achieved. If tensile strength and tensile extension are to be maximised, the holding time $t_Q$ should rather be held in the lower range, i.e. between 10-30 seconds. Longer holding times $t_Q$ of 30-60 seconds tend to have a positive impact on the forming properties. This is particularly true of the bending angle.

The martensite start temperature $T_{MS}$ can be estimated by means of the following equation:

$$T_{MS}[^\circ\ C.] = 539^\circ\ C. + (-423\%\ C - 30.4\%\ Mn - 7.5\%\ Si + 30\%\ Al)^\circ\ C./wt\ \%$$

Where % C: C content of the steel,
% Si: Si content of the steel,
% Al: Al content of the steel,
% Mn: Mn content of the steel.

In practice the martensite stop temperature $T_{Mf}$ can be calculated by means of the equation $$T_{Mf} = T_{Ms} - 272^\circ\ C.$$

This equation has been derived from the Koistinen-Marburger equation (see D. P. Koistinen, R. E. Marburger, Acta Metall. 7 (1959), p. 59) based on the following assumptions:

a) The martensite conversion is considered complete if a martensite proportion of 95% is reached.
b) The composition-dependent constant α is −0.011.
c) The martensite stop temperature is the same as the cooling stop temperature.

The cooling stop temperature $T_Q$ is typically at least 200° C.

Following cooling and holding of the flat steel product at the cooling stop temperature $T_Q$ the flat steel product, starting from the cooling stop temperature $T_Q$, is heated at a heating speed $\theta_{P1}$ of 2-80° C./s, in particular 2-40° C./s, to a temperature $T_P$ of 400-500° C., in particular 450-490° C.

Heating to the temperature $T_P$ preferably takes place here within a heating time $t_A$ of 1-150 seconds, to achieve optimum economic efficiency. At the same time the heating can make a contribution $x_{Dr}$ to a diffusion length $x_D$ illustrated in more detail below.

The purpose of heating and then optionally also holding the flat steel product at the temperature $T_P$ for a holding time $t_{Pi}$ of up to 500 seconds is to enrich the residual austenite with carbon from the supersaturated martensite. This is referred to as "carbon partitioning", and also as "partitioning" in technical parlance. The holding time $t_{Pi}$ is in particular up to 200 seconds, wherein holding times $t_{Pi}$ of less than 10 seconds are particularly practice-oriented.

Partitioning can take place as early as during heating as so-called "ramped partitioning", by holding at the partitioning temperature $T_P$ after heating (so-called "isothermal" partitioning) or by a combination of isothermal and ramped partitioning. In this way the high temperatures necessary for the subsequent hot-dip coating can be reached without particular tempering effects, i.e. over-tempering of the martensite. The slower heating speed $\theta_{P1}$ sought during ramped partitioning, in comparison with isothermal partitioning, allows particularly accurate control of the partitioning temperature $T_P$ specified in each case with reduced energy usage, since higher temperature gradients require greater energy expenditure in the system.

The negative effects of over-tempered martensite, such as coarse carbides, blocking plastic elongation and negatively affecting the strength of the martensite and the bending angle and hole expansion forming properties, are avoided by the heating according to the invention to the holding temperature $T_P$, wherein optional holding at the partitioning temperature further increases the reliability of avoiding over-tempered martensite. In particular the formation of carbides and the decomposition of residual austenite are suppressed in a controlled manner by observing the total partitioning time specified according to the invention $t_{PT}$, made up of the ramped partitioning time $t_{PR}$ and the isothermal partitioning time $t_{PI}$, and the partitioning temperature $T_P$.

At the same time the partitioning temperature $T_P$ specified according to the invention guarantees sufficient homogenisation of the carbon in the austenite, wherein this homogenisation can be influenced by the heating speed $\theta_{P1}$, the partitioning temperature $T_P$ and the optional holding at the partitioning temperature $T_P$ for a suitable holding time $t_{Pi}$.

To assess the homogenisation of the carbon in the austenite, the so-called "diffusion length $x_D$" is used. The diffusion length $x_D$ allows various heating rates, partitioning temperatures and possible partitioning times to be compared with one another. The diffusion length $x_D$ is made up of a component $x_{Dr}$, resulting from the ramped partitioning, and a component $x_{Di}$ resulting from the isothermal partitioning ($x_D = x_{Di} + x_{Dr}$). Depending on how the method is performed in each case the components $x_{Dr}$ or $x_{Di}$ can also be "0", wherein the result of the method according to the invention always gives a diffusion length $x_D$ of >0.

The diffusion length $x_{Di}$, i.e. the contribution to the diffusion length $x_D$ obtained in the course of the isothermal holding, can be calculated for the optionally performed isothermal partitioning using the following equation:

$$x_{Di}=6*\sqrt{D*t_{Pi}}$$

where $t_{Pi}$=Time for which isothermal holding is performed, in seconds, $D=D_o*\exp(-Q/RT)$, $D_o=3.72*10^{-5}$ $m^2/s$ Q=148 kJ/mol, R=8.314 J/(mol·K), T=Partitioning temperature $T_P$ in Kelvin Since during the ramped partitioning the redistribution of the carbon does not take place isothermally, to calculate the diffusion length $x_{Dr}$ achieved over the heating time a numerical approximation is used:

$$x_{Dr}=\Sigma_j(6*\sqrt{D_j*\Delta t_{Pr,j}})$$

wherein $\Delta t_{Pr,j}$ is the time step between two calculations in seconds and $D_j$ is the current diffusion coefficient D in each case, calculated as indicated above, at the instant of the respective time step. In determining the time step $\Delta t_{Pr,j}$ it is assumed by way of example that 1 second passes between two calculations ($\Delta t_{Pr,j}$=1 s).

Basically for the partitioning time $t_{Pr}$ during heating to the partitioning temperature $T_P$ the following applies:

$$t_{Pr}[s]=0-t_A.$$

That is to say, in cases in which the heating to the partitioning temperature $T_P$ takes place so quickly that during heating no significant redistribution of the carbon occurs, a time $t_{Pr}$=0 and consequently also a contribution $x_{Dr}$=0 can be assumed. A particularly economically efficient mode of operation results if the partitioning time $t_{PR}$ is limited to a maximum of 85 seconds.

The method according to the invention provides optimum results if the sum of the diffusion lengths $x_{Di}$, $x_{Dr}$ to be taken into account in each case is at least 1.0 μm, in particular at least 1.5 μm.

By setting the operating parameters of the heat treatment such that the diffusion length increases, the bending angle of the respective flat steel product can be improved, with only a slight effect on hole expansion. As the diffusion length increases further the hole expansion can also be improved, although this may be accompanied by a deterioration in the bending properties. Even greater diffusion length ultimately cause a deterioration in both bending properties and hole expansion. Optimum results are obtained if in the method according to the invention the operating parameters are set so that diffusion lengths of 1.5-5.7 μm, in particular of 2.0-4.5 μm, are achieved.

By means of the diffusion length $x_D$ or by changing the influencing variables essential to its value, by interaction with the cooling and holding step preceding partitioning the yield-to-tensile ratio can also be influenced. If, for example, by selecting a low cooling stop temperature $T_Q$ and/or a longer holding time $t_Q$ in the cooling step, a high martensite proportion of 40% or more is created, by selecting a high partitioning temperature $T_P$ and time $t_{Pt}$ a greater diffusion length $x_D$ and thus ultimately a high yield-to-tensile ratio can be achieved. If less than approximately 40% martensite is generated, then the influence of the diffusion length $x_D$ on the yield-to-tensile ratio is rather low.

The yield-to-tensile ratio is a measure of the hardening potential of the steel. A relatively low yield-to-tensile ratio of approximately 0.50 has a positive effect on the tensile extension, but has an adverse effect on hole expansion and the bending angle. A higher yield-to-tensile ratio of approximately 0.90 can improve hole expansion and the bending characteristics but leads to deterioration during tensile extension.

After partitioning the flat steel product is cooled from the partitioning temperature $T_P$ starting at a cooling speed $\theta_{P2}$ of between −3° C./s and −25° C./s, in particular −5° C./s to −15° C./s.

If in the course of the method according to the invention the flat steel product according to the invention is also to be provided with hot-dip coating, starting from the partitioning temperature $T_P$ at a cooling speed $\theta_{P2}$ it is initially cooled to a molten bath entry temperature $T_B$ of 400-<500° C.

The flat steel product then undergoes hot-dip coating by being passed through a molten bath upon leaving which the thickness of the protective layer created on the flat steel product is set in a conventional manner such as by stripping jets.

The flat steel product leaving the molten bath and provided with the protective layer is finally cooled to ambient temperature at a cooling rate of $\theta_{P2}$, in order to generate martensite again.

The method according to the invention is particularly suitable for the production of flat steel products, provided with a zinc coating. Other metallic protective layers that can be applied to the respective flat steel product by hot-dip galvanisation, such as ZnAl, ZnMG or similar protective coatings, are also possible, however.

The product produced according to the invention has a microstructure with (in surface percent) 25 to 80% tempered martensite (martensite from the first cooling step), 5 to 70% untempered, new martensite (martensite from the second cooling step), 5 to 30% residual austenite, less than 10% bainite (0% included) and less than 5% ferrite (0% included).

Ferrite: ferrite is a microstructure component which compared to martensite only makes a minor contribution to the strength of the material created according to the invention. Therefore the presence of ferrite in the microstructure of a flat steel product created according to the invention is undesirable and should always be less than 5 surface percent.

Bainite: during the phase conversion of austenite to bainite, part of the carbon dissolved in the material collects in front of the austenite-bainite phase boundary with another part being incorporated into the bainite during bainite conversion. So in the case of bainite formation a lower proportion of the carbon is available for enrichment in the residual austenite than in the case of no bainite formation. In order to have as much carbon as possible available for the residual austenite, the bainite content must be set as low as possible. To achieve the desired characteristic profile the bainite content should be limited to a maximum of 10 surface percent. More favourable properties result, however, at even lower bainite contents of less than 5 surface percent. Ideally the formation of bainite can be completely avoided, i.e. the bainite content reduced to as low as 0 surface percent.

Tempered martensite: tempered martensite, as the martensite present prior to partitioning, is the source of the carbon which during partitioning treatment diffuses in the residual austenite and stabilises this. In order to make sufficient carbon available, the proportion of tempered martensite should be at least 25 surface percent. It should not be above 80 surface percent, however, so that following the first cooling, proportions of at least 20 surface percent residual austenite can be set. The proportion of the residual austenite present after the first cooling is the basis for formation of the residual austenite upon completion of the heat treatments and of the untempered martensite from the second cooling process.

Untempered martensite: as a hard microstructure component martensite makes a considerable contribution to the strength of the material. To achieve high strength values, the proportion of untempered martensite should not be less than 5 surface percent, and that of tempered martensite 25 surface percent. The proportion of untempered martensite should not exceed 70 surface percent and that of tempered martensite 80 surface percent, to guarantee formation of sufficient residual austenite.

Residual austenite present in the final product at ambient temperature: residual austenite contributes to improving the elongation properties. The proportion should be at least 5 surface percent, to guarantee sufficient elongation of the material. If on the other hand the proportion of residual austenite exceeds 30 surface percent, this means that too little martensite is available to increase the strength.

The method according to the invention thus makes it possible to produce a refined flat steel product with a tensile strength of 1200 to 1900 MPa, a yield strength of 600 to 1400 MPa, a yield-to-tensile ratio of 0.40 to 0.95, an elongation ($A_{50}$) of 10 to 30% and very good formability. For a flat steel product according to the invention this is reflected in a product of $R_m$*A50 of 15000-35000 MPa %. At the same time the flat steel product according to the invention has a high bending angle $\alpha$ of 100 to 180° (for a mandrel radius of 2.0*sheet thickness in accordance with DIN EN 7438) and very good values for the hole expansion $\lambda$ of 50 to 120% (according to ISO-TS 16630). Thus a flat steel product according to the invention combines high strength with good formability characteristics.

FIG. 1 shows a variant of a method according to the invention, in which the heating time $t_A$ necessary for heating the flat steel product from the cooling stop temperature $T_Q$ to the partitioning temperature $T_P$ is equal to the ramped partitioning time $t_{Pr}$ and the flat steel product in the course of this method undergoes hot-dip galvanisation in a zinc bath ("zinc pot").

Basically the variant of the method according to the invention comprising hot-dip coating can be carried out in a conventional hot-dip coating facility, if certain modifications are made to this. In order to achieve strip temperatures of more than 930° C., ceramic nozzles may be required. The high cooling speeds $\theta_Q$ of up to −120K/s can be achieved with modern gas jet cooling. Heating to partitioning temperature $T_P$ taking place after holding at the stop temperature $T_Q$ can be achieved by using a booster. After the partitioning step the sheet passes through the molten bath and is cooled under controlled conditions to once again generate martensite.

The invention has been tried and tested with numerous embodiments.

To do so samples of cold-rolled steel strip produced from steels A-N in Table 1, were investigated.

The samples underwent the method steps specified according to the invention and shown in FIG. 1 with the process parameters shown in Table 2. In doing so the process parameters were varied between those which were according to the invention and those which were not, to demonstrate the effects of a procedure outside that specified according to the invention. Calculation of the diffusion length was based on time steps of 1 second each.

The mechanical properties of the cold-rolled strip samples obtained in this way are summarised in Table 3. The microstructure components of the cold-rolled strip samples obtained are given in "surface percent" in Table 4. Phase fractions of untempered and tempered martensite, bainite and ferrite were determined here according to ISO 9042 (optical determination). The residual austenite was also determined by X-ray diffractometry with an accuracy of +/−1 surface percent. Proportions of less than 5 surface percent are referred to as traces "Sp.".

In the tables, the claims and the description the following abbreviations are used:

| Abbreviation | Meaning | Unit |
|---|---|---|
| $\theta_{H1}$ | Heating speed for first heating phase before austenitisation | ° C./s |
| $T_w$ | Temperature for change from first to second heating phase before austenitisation | ° C. |
| $\theta_{H2}$ | Heating speed for second heating phase before austenitisation | ° C./s |
| $T_{Hz}$ | Austenitisation temperature | ° C. |
| $t_{Hz}$ | Austenitisation time | s |
| $\theta_Q$ | Cooling speed for quenching following austenitisation | ° C./s |
| $\theta_{Q(min)}$ | Minimum cooling speed to avoid ferritic or bainitic conversion | ° C./s |
| $T_Q$ | Cooling stop temperature for quenching following austenitisation | ° C. |
| $t_Q$ | Holding time at cooling stop temperature | s |
| $\theta_{P1}$ | Heating speed to temperature for isothermal partitioning | ° C./s |
| $t_A$ | Heating time to partitioning temperature $T_P$ | s |
| $t_{PR}$ | Partitioning time during heating (ramped partitioning) | s |
| $t_{PI}$ | Holding time for isothermal partitioning | s |
| $t_{PT}$ | Total partitioning time ($t_{PR}$ + $t_{PI}$) | s |
| $T_P$ | Temperature for isothermal partitioning | ° C. |
| $X_D$ | Total diffusion length | μm |
| $X_{DR}$ | Diffusion length from ramped partitioning | μm |
| $x_{Di}$ | Diffusion length from isothermal partitioning | μm |
| $\theta_{P2}$ | Cooling speed after partitioning | ° C./s |
| F | Ferrite | % |
| B | Bainite | % |
| $M_T$ | Tempered martensite (old martensite) | % |
| $M_N$ | Martensite from cooling after partitioning (new | % |
| RA | Residual austenite | % |
| $R_{p0,2}$ | Yield strength | MPa |
| $R_m$ | Tensile strength | MPa |
| $R_{p0.2}/R_m$ | Yield-to-tensile ratio | — |
| $A_{50}$ | Elongation | % |
| $R_m$ * $A_{50}$ | Product of tensile strength and elongation (=Measure of high strength and simultaneous good formability) | MPa * % |
| $\lambda$ | Hole expansion | % |
| $\alpha$ | Bending angle (after spring-back for a mandrel radius = 2 × sheet thickness) | ° |

TABLE 1

| Steel | C | Si | Mn | Al | P | S | N | Cr | V | Mo | Ti | | B | Σ (MLE) | CE |
|---|---|---|---|---|---|---|---|---|---|---|---|---|---|---|---|
| A | 0.169 | 1.47 | 1.55 | 0.038 | 0.015 | 0.0006 | 0.0037 | | | | 0.011 | 0.027 | | 0.04 | 0.67 |
| B | 0.230 | 1.66 | 1.87 | 0.037 | 0.009 | 0.0010 | 0.0049 | | | | 0.008 | 0.040 | | 0.05 | 0.82 |
| c | 0.224 | 0.16 | 1.67 | 1.410 | 0.016 | 0.0020 | 0.0042 | | | | | | | 0.00 | 0.53 |

TABLE 1-continued

| Steel | C | Si | Mn | Al | P | S | N | Cr | V | Mo | Ti | | B | Σ (MLE) | CE |
|---|---|---|---|---|---|---|---|---|---|---|---|---|---|---|---|
| D | 0.452 | 1.30 | 1.73 | 0.041 | 0.013 | 0.0020 | 0.0039 | | | | | | | 0.00 | 0.96 |
| E | 0.331 | 1.91 | 1.52 | 0.035 | 0.008 | 0.0010 | 0.0041 | | | | 0.071 | | | 0.07 | 0.90 |
| F | 0.193 | 1.41 | 1.53 | 0.460 | 0.009 | 0.0020 | 0.0040 | | | | | | | 0.00 | 0.68 |
| G | 0.183 | 1.78 | 2.34 | 0.032 | 0.008 | 0.0020 | 0.0047 | | | | 0.047 | 0.031 | | 0.08 | 0.87 |
| H | 0.196 | 1.64 | 3.14 | 0.012 | 0.011 | 0.0010 | 0.0040 | | | | 0.008 | | | 0.01 | 0.99 |
| I | 0.306 | 1.70 | 1.96 | 0.018 | 0.013 | 0.0010 | 0.0030 | | | | | | | 0.00 | 0.92 |
| J | 0.150 | 1.51 | 2.01 | 0.010 | 0.009 | 0.0010 | 0.0060 | 0.25 | | | 0.042 | | 0.0015 | 0.04 | 0.79 |
| K | 0.150 | 1.43 | 1.96 | 0.024 | 0.009 | 0.0022 | 0.0050 | 0.32 | | | 0.124 | | | 0.12 | 0.78 |
| L | 0.276 | 1.05 | 1.82 | 0.021 | 0.012 | 0.0020 | 0.0006 | 0.22 | | | 0.133 | | 0.0030 | 0.13 | 0.80 |
| M | 0.259 | 0.85 | 1.58 | 0.036 | 0.010 | 0.0015 | 0.0070 | | 0.067 | | 0.084 | | 0.0040 | 0.15 | 0.68 |
| N | 0.174 | 0.97 | 1.47 | 0.028 | 0.009 | 0.0010 | 0.0040 | | | 0.23 | | | | 0.00 | 0.63 |

Figures in wt %., Residual iron and unavoidable impurities

TABLE 2

| Steel | Trial No. | $\theta_{H1}$ [° C./s] | Tw [° C.] | $\theta_{H2}$ [° C./s] | $A_{c3}$ [° C.] | $T_{HZ}$ [° C.] | $t_{Hz}$ [s] | $\theta_{Q(min)}$ [° C./s] | $\theta_Q$ [° C./s] | $T_Q$ [° C.] | $T_{MS}$ [° C.] | $t_Q$ [s] |
|---|---|---|---|---|---|---|---|---|---|---|---|---|
| A | 1 | 11 | 270 | 3 | 892 | 920 | 84 | −110 | −115 | 250 | 411 | 10 |
| A | 2 | 15 | 300 | 4 | 892 | 920 | 84 | −110 | −70 | 350 | 411 | 20 |
| A | 3 | 5 | 270 | 5 | 892 | 930 | 50 | −110 | −120 | 270 | 411 | 12 |
| A | 4 | 10 | 300 | 5 | 892 | 830 | 50 | −110 | −110 | 460 | 411 | 0 |
| A | 5 | 10 | 270 | 3 | 892 | 910 | 110 | −110 | −110 | 320 | 411 | 10 |
| B | 6 | 18 | 270 | 3 | 887 | 920 | 75 | −67 | −70 | 310 | 374 | 0 |
| B | 7 | 12 | 375 | 5 | 887 | 930 | 48 | −67 | −75 | 310 | 374 | 40 |
| B | 8 | 5 | 270 | 5 | 887 | 905 | 115 | −67 | −70 | 310 | 374 | 40 |
| B | 9 | 14 | 300 | 4 | 887 | 925 | 65 | −67 | −70 | 250 | 374 | 15 |
| B | 10 | 5 | 300 | 5 | 887 | 820 | 48 | −67 | −20 | 470 | 374 | 0 |
| B | 11 | 5 | 270 | 5 | 887 | 915 | 80 | −67 | −75 | 250 | 374 | 10 |
| C | 12 | 11 | 270 | 3 | 821 | 930 | 70 | −90 | −90 | 290 | 435 | 20 |
| C | 13 | 11 | 270 | 3 | 821 | 930 | 70 | −90 | −105 | 210 | 435 | 10 |
| C | 14 | 5 | 270 | 5 | 821 | 890 | 125 | −90 | −95 | 250 | 435 | 12 |
| D | 15 | 6 | 300 | 4 | 832 | 895 | 100 | −42 | −45 | 250 | 287 | 50 |
| D | 16 | 5 | 270 | 5 | 832 | 880 | 140 | −42 | −50 | 200 | 287 | 10 |
| D | 17 | 9 | 290 | 3 | 832 | 920 | 55 | −42 | −50 | 230 | 287 | 15 |
| E | 18 | 5 | 270 | 5 | 879 | 930 | 50 | −38 | −40 | 310 | 340 | 14 |
| E | 19 | 11 | 290 | 3 | 879 | 920 | 65 | −38 | −55 | 275 | 340 | 10 |
| E | 20 | 11 | 270 | 4 | 879 | 930 | 55 | −38 | −10 | 300 | 340 | 0 |
| E | 21 | 10 | 270 | 3 | 879 | 930 | 55 | −38 | −50 | 300 | 340 | 20 |
| F | 22 | 10 | 350 | 3 | 884 | 930 | 45 | −90 | −90 | 255 | 414 | 30 |
| F | 23 | 5 | 270 | 5 | 884 | 920 | 55 | −90 | −50 | 270 | 414 | 15 |
| F | 24 | 5 | 270 | 5 | 884 | 930 | 60 | −90 | −100 | 310 | 414 | 12 |
| F | 25 | 11 | 270 | 4 | 884 | 890 | 150 | −90 | −100 | 250 | 414 | 10 |
| G | 26 | 10 | 300 | 5 | 903 | 930 | 60 | −48 | −60 | 290 | 378 | 10 |
| G | 27 | 11 | 270 | 4 | 903 | 930 | 60 | −48 | −60 | 250 | 378 | 10 |
| H | 28 | 5 | 270 | 5 | 893 | 930 | 66 | −31 | −45 | 290 | 348 | 24 |
| H | 29 | 5 | 270 | 5 | 893 | 905 | 80 | −31 | −40 | 240 | 348 | 24 |
| H | 30 | 10 | 270 | 4 | 893 | 905 | 80 | −31 | −40 | 240 | 348 | 10 |
| H | 31 | 11 | 300 | 5 | 893 | 930 | 52 | −31 | −50 | 270 | 348 | 15 |
| H | 32 | 5 | 270 | 5 | 893 | 930 | 52 | −31 | −30 | 250 | 348 | 0 |
| H | 33 | 9 | 255 | 3 | 893 | 930 | 66 | −31 | −80 | 210 | 348 | 5 |
| H | 34 | 20 | 295 | 3 | 893 | 920 | 70 | −31 | −60 | 320 | 348 | 12 |
| H | 35 | 5 | 270 | 5 | 893 | 920 | 70 | −31 | −60 | 270 | 348 | 70 |
| I | 36 | 14 | 310 | 5 | 874 | 905 | 75 | −50 | −65 | 200 | 337 | 17 |
| I | 37 | 10 | 270 | 3 | 874 | 900 | 73 | −50 | −70 | 310 | 337 | 15 |
| I | 38 | 10 | 270 | 3 | 874 | 880 | 98 | −50 | −50 | 285 | 337 | 0 |
| I | 39 | 15 | 290 | 5 | 874 | 930 | 24 | −50 | −75 | 230 | 337 | 20 |
| J | 40 | 5 | 270 | 5 | 899 | 930 | 20 | −94 | −95 | 350 | 403 | 10 |
| J | 41 | 20 | 300 | 3 | 899 | 910 | 46 | −94 | −100 | 200 | 403 | 0 |
| J | 42 | 5 | 270 | 4 | 899 | 910 | 46 | −94 | −105 | 265 | 403 | 16 |
| J | 43 | 5 | 270 | 5 | 899 | 905 | 78 | −94 | −100 | 320 | 403 | 12 |
| K | 44 | 10 | 300 | 3 | 895 | 920 | 57 | −86 | −95 | 300 | 406 | 10 |
| K | 45 | 8 | 270 | 4 | 895 | 920 | 57 | −86 | −95 | 350 | 406 | 17 |
| K | 46 | 5 | 270 | 5 | 895 | 910 | 83 | −86 | −87 | 340 | 406 | 0 |
| L | 47 | 5 | 270 | 5 | 850 | 900 | 60 | −79 | −80 | 220 | 360 | 14 |
| L | 48 | 10 | 290 | 4 | 850 | 875 | 95 | −79 | −80 | 275 | 360 | 12 |
| L | 49 | 5 | 270 | 5 | 850 | 890 | 75 | −79 | −90 | 300 | 360 | 18 |
| M | 50 | 5 | 270 | 3 | 852 | 895 | 80 | −112 | −120 | 240 | 376 | 10 |
| M | 51 | 5 | 270 | 3 | 852 | 870 | 120 | −112 | −120 | 285 | 376 | 16 |
| M | 52 | 5 | 270 | 3 | 852 | 890 | 75 | −112 | −115 | 200 | 376 | 80 |
| N | 53 | 10 | 270 | 3 | 876 | 930 | 38 | −103 | −105 | 350 | 414 | 12 |
| N | 54 | 11 | 270 | 4 | 876 | 900 | 80 | −103 | −110 | 250 | 414 | 10 |
| N | 55 | 11 | 270 | 4 | 876 | 900 | 80 | −103 | −115 | 310 | 414 | 10 |

TABLE 2-continued

| Steel | Trial No | $\theta_{p1}$ [° C./s] | $t_{PR}$ [s] | $t_{PI}$ [s] | $T_p$ [° C.] | $X_D$ [μm] | $\theta_{p2}$ [° C./s] | According to the invention? |
|---|---|---|---|---|---|---|---|---|
| A | 1 | 6.5 | 30.8 | 5 | 450 | 2.27 | −8 | YES |
| A | 2 | 80 | 1.8 | 22 | 490 | 7.71 | −8 | NO |
| A | 3 | 8 | 27.5 | 0 | 490 | 2.74 | −8 | YES |
| A | 4 | 0 | 0.0 | 34 | 460 | 1.14 | −8 | NO |
| A | 5 | 10 | 12.0 | 10 | 440 | 2.12 | −8 | YES |
| B | 6 | 90 | 2.0 | 28 | 490 | 9.44 | −10 | NO |
| B | 7 | 90 | 2.0 | 16 | 490 | 5.83 | −10 | NO |
| B | 8 | 75 | 2.1 | 20 | 470 | 5.14 | −10 | YES |
| B | 9 | 12 | 18.3 | 5 | 470 | 2.31 | −10 | YES |
| B | 10 | 0 | 0.0 | 218 | 470 | 3.40 | −10 | NO |
| B | 11 | 5 | 48.0 | 0 | 490 | 3.98 | −10 | YES |
| C | 12 | 85 | 2.4 | 16 | 490 | 5.83 | −7 | NO |
| C | 13 | 4.5 | 62.2 | 0 | 490 | 4.34 | −7 | YES |
| C | 14 | 3 | 66.7 | 4 | 450 | 3.43 | −7 | YES |
| D | 15 | 80 | 3.0 | 22 | 490 | 7.70 | −11 | NO |
| D | 16 | 6 | 41.7 | 5 | 450 | 2.31 | −11 | YES |
| D | 17 | 3.5 | 68.6 | 0 | 470 | 3.74 | −11 | YES |
| E | 18 | 5 | 36.0 | 0 | 490 | 3.60 | −18 | YES |
| E | 19 | 4 | 50.0 | 10 | 475 | 4.61 | −18 | YES |
| E | 20 | 85 | 2.1 | 25 | 480 | 7.49 | −18 | NO |
| E | 21 | 75 | 2.4 | 7 | 480 | 2.06 | −18 | YES |
| F | 22 | 9 | 26.1 | 0 | 490 | 2.37 | −12 | YES |
| F | 23 | 90 | 2.4 | 15 | 490 | 5.51 | −12 | NO |
| F | 24 | 5 | 32.0 | 0 | 470 | 2.71 | −12 | YES |
| F | 25 | 7.5 | 32.0 | 0 | 490 | 2.86 | −12 | YES |
| G | 26 | 11 | 18.2 | 0 | 490 | 3.27 | −11 | YES |
| G | 27 | 6.5 | 34.6 | 0 | 475 | 2.46 | −11 | YES |
| H | 28 | 75 | 2.7 | 15 | 490 | 5.33 | −20 | YES |
| H | 29 | 75 | 2.8 8 | 20 | 450 | 3.61 | −20 | YES |
| H | 30 | 2.5 | 84.0 | 0 | 450 | 3.55 | −20 | YES |
| H | 31 | 3.5 | 62.9 | 0 | 490 | 5.59 | −20 | YES |
| H | 32 | 95 | 2.5 | 26 | 490 | 8.98 | −20 | NO |
| H | 33 | 95 | 2 9 | 16 | 490 | 5.81 | −20 | NO |
| H | 34 | 5 | 26.0 | 22 | 450 | 5.51 | −20 | YES |
| H | 35 | 7 | 30.0 | 0 | 480 | 2.44 | −20 | NO |
| I | 36 | 4.5 | 55.6 | 0 | 450 | 2.02 | −10 | YES |
| I | 37 | 5 | 32.0 | 0 | 470 | 2.59 | −10 | YES |
| I | 38 | 95 | 2.2 | 25 | 490 | 8.66 | −10 | NO |
| I | 39 | 6 | 40.8 | 0 | 475 | 2.54 | −10 | YES |
| J | 40 | 2 | 45.0 | 0 | 440 | 3.51 | −16 | YES |
| J | 41 | 80 | 3.6 | 28 | 490 | 9.61 | −16 | NO |
| J | 42 | 6 | 37.5 | 5 | 490 | 4.86 | −16 | YES |
| J | 43 | 4 | 32.5 | 0 | 450 | 2.21 | −16 | YES |
| K | 44 | 4.5 | 33.3 | 0 | 450 | 2.02 | −9 | YES |
| K | 45 | 7 | 17.9 | 0 | 475 | 2.31 | −9 | YES |
| K | 46 | 95 | 1.6 | 27 | 490 | 9.29 | −9 | NO |
| L | 47 | 3 | 83.3 | 0 | 470 | 4.33 | −18 | YES |
| L | 48 | 6 | 33.3 | 10 | 475 | 2.60 | −18 | YES |
| L | 49 | 20 | 9.5 | 5 | 490 | 2.74 | −18 | YES |
| M | 50 | 4.5 | 53.3 | 5 | 480 | 4.81 | −13 | YES |
| M | 51 | 7 | 27.9 | 8 | 480 | 4.84 | −13 | YES |
| M | 52 | 85 | 3.4 | 22 | 490 | 7.72 | −13 | NO |
| N | 53 | 6 | 23.3 | 0 | 490 | 3.62 | −15 | YES |
| N | 54 | 4 | 51.3 | 5 | 455 | 3.28 | −15 | YES |
| N | 55 | 2.5 | 58.0 | 5 | 455 | 4.62 | −15 | YES |

TABLE 3

| Steel | Trial No | $R_{P0.2}$ [MPa] | $R_m$ [MPa] | $R_{p0.2}/R_m$ [0] | $A_{50}$ [%] | $R_m*A_{50}$ [MPa %] | λ [%] | $\alpha_{max}$ [°] | According to the invention? |
|---|---|---|---|---|---|---|---|---|---|
| A | 1 | 1014 | 1257 | 0.81 | 13 | 16341 | 62 | 133 | Y |
| A | 2 | 979 | 1070 | 0.91 | 12 | 12840 | 6 | 117 | N |
| A | 3 | 983 | 1231 | 0.80 | 16 | 19696 | 5 | 147 | Y |
| A | 4 | 400 | 840 | 0.48 | 25 | 21000 | n.d. | n.d. | N |
| A | 5 | 768 | 1202 | 0.64 | 17 | 20434 | 51 | 139 | Y |
| B | 6 | 828 | 1005 | 0.82 | 8 | 8040 | 63 | 96 | N |
| B | 7 | 958 | 1245 | 0.77 | 11 | 13695 | 5 | 128 | N |
| B | 8 | 932 | 1303 | 0.72 | 15 | 19545 | 5 | 114 | Y |
| B | 9 | 1071 | 1399 | 0.77 | 11 | 15389 | 6 | 125 | Y |
| B | 10 | 420 | 1060 | 0.40 | 12 | 12720 | n. | n.d. | N |
| B | 11 | 1143 | 1276 | 0.90 | 12 | 15312 | 74 | 105 | Y |

TABLE 3-continued

| | | | | | | | | | |
|---|---|---|---|---|---|---|---|---|---|
| C | 12 | 722 | 1256 | 0.57 | 15 | 18840 | 26 | 109 | N |
| C | 13 | 1040 | 1342 | 0.77 | 14 | 18788 | 68 | 117 | Y |
| C | 14 | 917 | 1289 | 0.71 | 12 | 15468 | 55 | 133 | Y |
| D | 15 | 995 | 1432 | 0.69 | 14 | 20048 | 41 | 108 | N |
| D | 16 | 912 | 1484 | 0.61 | 16 | 23744 | 5 | 130 | Y |
| D | 17 | 874 | 1320 | 0.66 | 13 | 17160 | 73 | 143 | Y |
| E | 18 | 935 | 1541 | 0.61 | 14 | 21574 | 55 | 109 | Y |
| E | 19 | 1118 | 1474 | 0.76 | 12 | 17688 | 77 | 121 | Y |
| E | 20 | 632 | 1150 | 0.55 | 9 | 10350 | 3 | 90 | N |
| E | 21 | 1093 | 1405 | 0.78 | 15 | 21075 | 68 | 105 | Y |
| F | 22 | 914 | 1236 | 0.74 | 14 | 17304 | 68 | 130 | Y |
| F | 23 | 702 | 1149 | 0.61 | 15 | 17235 | 38 | 116 | N |
| F | 24 | 727 | 1371 | 0.53 | 16 | 21936 | 51 | 139 | Y |
| F | 25 | 1064 | 1206 | 0.88 | 13 | 15678 | 8 | 127 | Y |
| G | 26 | 1101 | 1497 | 0.74 | 13 | 19461 | 59 | 114 | Y |
| G | 27 | 1272 | 1522 | 0.84 | 11 | 16742 | 72 | 137 | YES |

| Steel | Trial No | $R_{P0.2}$ [MPa] | $R_m$ (MPa) | $R_{p0.2}/R_m$ [—] | $A_{50}$ [%] | $R_m*A_{50}$ [MPa %] | λ [%] | $\alpha_{max}$ [°] | According to the invention? |
|---|---|---|---|---|---|---|---|---|---|
| H | 28 | 760 | 1357 | 0.56 | 13 | 17641 | 52 | 111 | YES |
| H | 29 | 874 | 1412 | 0.62 | 12 | 16944 | 57 | 106 | YES |
| H | 30 | 826 | 1398 | 0.59 | 16 | 22368 | 78 | 128 | YES |
| H | 31 | 797 | 1261 | 0.63 | 17 | 21437 | 63 | 135 | YES |
| H | 32 | 893 | 1056 | 0.85 | 13 | 13728 | 48 | 98 | NO |
| H | 33 | 1114 | 1199 | 0.93 | 13 | 15587 | 86 | 125 | NO |
| H | 34 | 650 | 1315 | 0.49 | 18 | 23670 | 61 | 120 | YES |
| H | 35 | 852 | 1194 | 0.71 | 15 | 17910 | 49 | 109 | NO |
| I | 36 | 1066 | 1476 | 0.72 | 14 | 20664 | 53 | 102 | YES |
| I | 37 | 898 | 1384 | 0.65 | 18 | 24912 | 59 | 117 | YES |
| I | 38 | 978 | 1132 | 0.86 | 8 | 9056 | 72 | 103 | NO |
| I | 39 | 933 | 1447 | 0.64 | 15 | 21705 | 55 | 129 | YES |
| J | 40 | 788 | 1273 | 0.62 | 21 | 26733 | 51 | 122 | YES |
| J | 41 | 1068 | 1102 | 0.97 | 4 | 4408 | 57 | 93 | NO |
| J | 42 | 1037 | 1463 | 0.71 | 17 | 24871 | 75 | 131 | YES |
| J | 43 | 985 | 1379 | 0.71 | 19 | 26201 | 54 | 114 | YES |
| K | 44 | 1202 | 1576 | 0.76 | 13 | 20488 | 58 | 112 | YES |
| K | 45 | 954 | 1398 | 0.68 | 16 | 22368 | 66 | 130 | YES |
| K | 46 | 1017 | 1255 | 0.81 | 8 | 10040 | 71 | 108 | NO |
| L | 47 | 1263 | 1642 | 0.77 | 12 | 19704 | 56 | 119 | YES |
| L | 48 | 991 | 1482 | 0.67 | 15 | 22230 | 51 | 131 | YES |
| L | 49 | 870 | 1451 | 0.60 | 17 | 24667 | 68 | 139 | YES |
| M | 50 | 1126 | 1401 | 0.80 | 16 | 22416 | 62 | 109 | YES |
| M | 51 | 930 | 1529 | 0.61 | 13 | 19877 | 51 | 123 | YES |
| M | 52 | 1242 | 1297 | 0.96 | 6 | 7782 | 76 | 117 | NO |
| N | 53 | 905 | 1386 | 0.65 | 19 | 26334 | 63 | 129 | YES |
| N | 54 | 1132 | 1475 | 0.77 | 12 | 17700 | 77 | 136 | YES |
| N | 55 | 1063 | 1458 | 0.73 | 16 | 23328 | 69 | 125 | YES |

n.d. = not determined

TABLE 4

| Steel | Trial No | F [%] | MT [%] | Contains over-tempered martensite? | RA [%-] | $M_N$ [%] | B [%] | According to the invention? |
|---|---|---|---|---|---|---|---|---|
| A | 1 | 0 | 80 | NO | 10 | 10 | Sp. | YES |
| A | 2 | 0 | 55 | YES | 5 | 40 | Sp. | NO |
| A | 3 | 0 | 80 | NO | 13 | 7 | Sp. | YES |
| A | 4 | 76 | 0 | NO | 9 | 15 | Sp. | NO |
| A | 5 | 0 | 69 | NO | 16 | 15 | Sp. | YES |
| B | 6 | 4 | 45 | YES | 11 | 40 | 0 | NO |
| B | 7 | 0 | 55 | YES | 9 | 25 | 11 | NO |
| B | 8 | 0 | 55 | NO | 16 | 29 | 0 | YES |
| B | 9 | 0 | 78 | NO | 12 | 10 | 0 | YES |
| B | 10 | 62 | 0 | NO | 18 | 5 | 5 | NO |
| B | 11 | 0 | 79 | NO | 8 | 8 | 5 | YES |
| C | 12 | Sp. | 55 | YES | 15 | 30 | 0 | NO |
| C | 13 | 0 | 80 | NO | 11 | 9 | 0 | YES |
| C | 14 | 0 | 75 | NO | 14 | 11 | 0 | YES |
| D | 15 | Sp. | 45 | YES | 21 | 34 | Sp. | NO |
| D | 16 | 0 | 70 | NO | 18 | 12 | Sp. | YES |
| D | 17 | 0 | 56 | NO | 19 | 25 | Sp. | YES |
| E | 18 | 0 | 35 | NO | 24 | 41 | Sp. | YES |
| E | 19 | 0 | 60 | NO | 14 | 26 | Sp. | YES |

TABLE 4-continued

| Steel | Trial No | F [%] | MT [%] | Contains over-tempered martensite? | RA [%-] | $M_N$ [%] | B [%] | According to the invention? |
|---|---|---|---|---|---|---|---|---|
| E | 20 | 20 | 30 | YES | 9 | 21 | 20 | NO |
| E | 21 | 0 | 50 | NO | 14 | 36 | Sp. | YES |
| F | 22 | 0 | 80 | NO | 13 | 7 | 0 | YES |
| F | 23 | 17 | 65 | NO | 8 | 10 | 0 | NO |
| F | 24 | 0 | 59 | NO | 16 | 25 | 0 | YES |
| F | 25 | 0 | 80 | NO | 7 | 13 | 0 | YES |
| G | 26 | 0 | 65 | NO | 12 | 23 | 0 | YES |
| G | 27 | 0 | 80 | NO | 5 | 15 | 0 | YES |
| H | 28 | Sp. | 50 | NO | 15 | 35 | 0 | YES |
| H | 29 | 0 | 74 | NO | 11 | 15 | 0 | YES |
| H | 30 | Sp. | 72 | NO | 18 | 10 | 0 | YES |
| H | 31 | Sp. | 66 | NO | 14 | 20 | 0 | YES |
| H | 32 | 0 | 75 | YES | 8 | 17 | 0 | NO |
| H | 33 | 0 | 85 | YES | 8 | 7 | 0 | NO |
| H | 34 | Sp. | 23 | NO | 17 | 60 | 0 | YES |
| H | 35 | Sp. | 70 | NO | 10 | 20 | 0 | NO |
| I | 36 | Sp. | 77 | NO | 18 | 5 | 0 | YES |
| I | 37 | Sp. | 40 | NO | 19 | 41 | 0 | YES |
| I | 38 | Sp. | 55 | YES | 6 | 39 | 0 | NO |
| I | 39 | Sp. | 75 | NO | 12 | 13 | 0 | YES |
| J | 40 | 0 | 51 | NO | 9 | 40 | 0 | YES |
| J | 41 | 0 | 95 | YES | 3 | 2 | 0 | NO |
| J | 42 | 0 | 80 | NO | 10 | 10 | 0 | YES |
| J | 43 | 0 | 61 | NO | 14 | 25 | 0 | YES |
| K | 44 | 0 | 67 | NO | 12 | 21 | 0 | YES |
| K | 45 | 0 | 40 | NO | 17 | 43 | 0 | YES |
| K | 46 | 0 | 48 | YES | 7 | 46 | Sp. | NO |
| L | 47 | 0 | 80 | NO | 11 | 9 | 0 | YES |
| L | 48 | 0 | 64 | NO | 16 | 20 | 0 | YES |
| L | 49 | Sp. | 51 | NO | 19 | 30 | 0 | YES |
| M | 50 | 0 | 78 | NO | 13 | 9 | 0 | YES |
| M | 51 | 0 | 65 | NO | 14 | 21 | 0 | YES |
| M | 52 | 0 | 90 | YES | 5 | 5 | 0 | NO |
| N | 53 | 0 | 45 | NO | 17 | 38 | 0 | YES |
| N | 54 | 0 | 80 | NO | 11 | 9 | 0 | YES |
| N | 55 | 0 | 70 | NO | 12 | 18 | 0 | YES |

Sp. = Traces

The invention claimed is:

1. A flat steel product which has a tensile strength $R_m$ of at least 1200 MPa and which consists of a steel that contains (in wt %)

C: 0.10-0.50%,
Si: 0.1-2.5%,
Mn: 1.0-3.5%
Al: up to 2.5%,
P: up to 0.020%,
S: up to 0.003%,
N: up to 0.02%,
and optionally one or more of the elements "Cr, Mo, V, Ti, Nb, B and Ca" in the following quantities:
Cr: 0.1-0.5%,
Mo: 0.1-0.3%,
V: 0.01-0.1%,
Ti: 0.001-0.15%,
Nb: 0.02-0.05%,
wherein Σ(V, Ti, Nb) ≤0.2% for the sum Σ(V, Ti, Nb) of the quantities of V, Ti and Nb,
B: 0.0005-0.005%, and
Ca: up to 0.01% in addition to Fe and unavoidable impurities,
and a microstructure with (in surface percent) less than 5% ferrite, less than 5% bainite, 5-70% untempered martensite, 5-30% residual austenite and 25-80% tempered martensite, at least 99% of the iron carbide contained in the tempered martensite having a size of less than 500 nm.

2. The flat steel product according to claim 1, wherein (in wt %) the Al content is 0.01-1.5%, the Cr content is 0.20-0.35 wt %, the V content is 0.04-0.08%, the Ti content is 0.008-0.14%, the B content is 0.002-0.004% or the Ca content is 0.0001-0.006%.

3. The flat steel product according to claim 1, wherein for the carbon equivalent CE of its steel the following is valid:

$$0.35\text{ wt }\% \leq CE \leq 1.2\text{ wt }\%$$

$$\text{wherein } CE = \%\,C + (\%\,Mn + \%\,Si)/6 + (\%\,Cr + \%\,Mo + \%\,V)/5 + (\%\,Ni + \%\,Cu)/15,$$

% C: C content of the steel,
% Mn: Mn content of the steel,
% Si: Si content of the steel,
% Cr: Cr content of the steel,
% Mo: Mo content of the steel,
% V: V content of the steel,
% Ni: Ni content of the steel,
% Cu: Cu content of the steel.

4. The flat steel product according to claim 3, wherein for the carbon equivalent CE the following is valid:

$$0.5\text{ wt }\% \leq CE \leq 1.0\text{ wt }\%$$

5. The flat steel product according to claim 1, wherein it is provided with a metallic protective layer applied by hot-dip coating.

6. A method for producing a high-strength flat steel product, according to claim 1 comprising the following work steps:

providing an uncoated flat steel product of a steel that contains (in wt %)

C: 0.10-0.50%,

Si: 0.1-2.5%,

Mn: 1.0-3.5%,

Al: up to 2.5%,

P: up to 0.020%,

S: up to 0.003%,

N: up to 0.02%, and optionally one or more of the elements "Cr, Mo, V, Ti, Nb, B and Ca" in the following quantities:

Cr: 0.1-0.5%,

Mo: 0.1-0.3%,0

V: 0.01-0.1%,

Ti: 0.001-0.15%.

Nb: 0.02-0.05%.

wherein $\Sigma(V,Ti,Nb) \leq 0.2\%$ for the sum $\Sigma(V,Ti,Nb)$ of the quantities of V, Ti and Nb,

B: 0.0005-0.005%,

Ca: up to 0.01% in addition to Fe and unavoidable impurities;

heating the flat steel product to an austenitisation temperature $T_{HZ}$ above the $A_{c3}$ temperature of the steel of the flat steel product and with a maximum of 960 ° C. at a heating speed $\theta_{H1}$, $\theta_{H2}$ of at least 3° C./s;

holding the flat steel product at the austenitisation temperature for an austenitisation period $t_{Hz}$ *of* 20-180 seconds;

cooling of the flat steel product to a cooling stop temperature $T_Q$, greater than the martensite stop temperature $T_{Mf}$ and less than the martensite start temperature $T_{Ms}$ ($T_{Mf}<T_Q<T_{MS}$), at a cooling speed $\theta_Q$ for which the following is valid:

$$\theta_Q \leq \theta_{Q(min)}$$

where $\theta_{Q(min)}$[° C./s]=−314.35° C./s +(268.74% C + 56.27% Si+58.50% Al+43.40% Mn+195.02% Mo+166.60% Ti+199.19% Nb)° C./(wt % ·s), % C: C content of the steel, % Si: Si content of the steel, % Al: Al content of the steel, % Mn: Mn content of the steel, % Mo: Mo content of the steel, % Ti: Ti content of the steel, % Nb: Nb content of the steel;

holding the flat steel product at the cooling stop temperature $T_Q$ for a holding time $t_Q$ of 10-60 seconds;

starting from the cooling stop temperature $T_Q$, heating the flat steel product at a heating speed $\theta_{P1}$ of 2-80° C./s to a partitioning temperature $T_P$ of 400-500° C.;

optionally holding the flat steel product isothermally at the partitioning temperature $T_P$ for a holding time $t_{P1}$ of up to 500 seconds;

starting from the partitioning temperature $T_P$ cooling the flat steel product at a cooling speed $\theta_{P2}$ of between −3° C./s and −25° C./s.

7. The method according to claim 6, wherein in the cooling starting from the partitioning temperature $T_P$ at a cooling speed $\theta_{P2}$ the flat steel product is initially cooled to a molten bath entry temperature $T_B$ of 400 to <500° C.;

then the flat steel product cooled to the molten bath entry temperature $T_B$ is hot-dip coated by being passed through a molten bath and the thickness of the protective layer created on the flat steel product is set;

and finally the flat steel product leaving the molten bath with the protective layer is cooled to ambient temperature at a cooling speed $\theta_{P2}$.

8. The method according to claim 6, wherein to the austenitisation temperature $T_{HZ}$ takes place in two consecutive stages without interruption at different heating speeds $\theta_{H1}$, $\theta_{H2}$.

9. The method according to claim 6, wherein the heating speed $\theta_{H1}$of the first stage is 5-25° C./s and the heating speed $\theta_{H2}$ of the second stage is 3-10° C.

10. The method according to claim 6, wherein the flat steel product is heated at the first heating speed $\theta_{H1}$ to an intermediate temperature $T_W$ of 200-500° C. and in that the heating is then continued at the second heating speed $\theta_{H2}$ to the austenitisation temperature $T_{HZ}$ .

11. The method according to claim 6, wherein the cooling speed $\theta_Q$ is −20° C./s to −120° C./s.

12. The method according to claim 6, wherein the cooling stop temperature $T_Q$ is at least 200° C.

13. The method according to claim 6, wherein the holding time $t_Q$, for which the flat steel product is held at the cooling stop temperature $T_Q$ is 12-40 seconds.

14. The method according to claim 6, wherein the heating speed $\theta_{P1}$ at which the heating takes place from the cooling stop temperature $T_Q$ is 2-80° C./s.

15. The method according to claim 6, wherein heating to the partitioning temperature $T_P$ takes place within a heating time $t_A$ of 1-150 seconds.

16. The method according to claim 15, wherein for the time $t_{Pr}$ of partitioning during heating to partitioning temperature $T_P$ the following is valid:

$$t_{Pr}[s]=0-t_A.$$

17. The method according to claim 6, wherein for a diffusion length $X_D$ the following is valid:

$$X_D \geq 1.0\ \mu m$$

where $X_D=X_{Di}+X_{Dr}$ $x_{Di}$: the contribution obtained in the course of isothermic holding to the diffusion length $x_D$, calculated according to the formula $$x_{Di}=6*\sqrt{D*t_{Pi}}$$

where $t_{Pi}$=time for which isothermal holding is performed, in seconds, $D=D_0*\exp(-Q/RT)$, $D_0=3.72*10^{-5}$ $m^2/S$ Q=148 kJ/mol, R=8.314 J/(mol·K)

T =partitioning temperature $T_P$ in Kelvin and $X_{Dr}$: the contribution obtained in the course of heating to the partitioning temperature to the diffusion length $X_D$, calculated according to the formula $$X_{Dr}=\Sigma_j(6*\sqrt{D_j*\Delta t_{Pr,j}})$$

where $\Delta t_{Pr,j}$=is the time step between two calculations in seconds, $D_j=D_0*\exp(-Q/RT_j)$, $D_0=3.72*10^{-5}$ $m^2/s$, Q=148 kJ/mol, R=8.314 J/(mol·K)

$T_j$=current partitioning temperature $T_P$ in each case in Kelvin.

wherein $x_{Di}$ or $x_{Dr}$ can also be 0.

* * * * *